US012339008B2

(12) United States Patent
Wu et al.

(10) Patent No.: US 12,339,008 B2
(45) Date of Patent: Jun. 24, 2025

(54) STOVE AND STOVE SYSTEM CAPABLE OF CONTROLLING FLAME SHAPE

(71) Applicant: Jinhong Wu, Guangdong (CN)

(72) Inventors: Jinhong Wu, Guangdong (CN); Dewen Zeng, Guangdong (CN); Shijun Zhang, Guangdong (CN)

(73) Assignee: Jinhong Wu, Guangdong (CN)

( * ) Notice: Subject to any disclaimer, the term of this patent is extended or adjusted under 35 U.S.C. 154(b) by 0 days.

(21) Appl. No.: 18/760,071

(22) Filed: Jul. 1, 2024

(65) Prior Publication Data

US 2025/0180214 A1 Jun. 5, 2025

(30) Foreign Application Priority Data

Jul. 4, 2023 (CN) ..... 202321739138.4

(51) Int. Cl.
*F24B 5/02* (2006.01)
*F24C 15/00* (2006.01)

(52) U.S. Cl.
CPC ..... *F24B 5/021* (2013.01); *F24C 15/00* (2013.01)

(58) Field of Classification Search
CPC ..... F24B 5/021; F24C 15/00
See application file for complete search history.

(56) References Cited

U.S. PATENT DOCUMENTS 1,310,327 A * 7/1919 Dutton ..... F23H 13/00 126/163 A
2,346,586 A * 4/1944 Keown ..... F23L 9/06 126/163 A
11,774,089 B1 * 10/2023 Weilert ..... F23B 1/28 126/540
11,953,198 B2 * 4/2024 Harrington ..... F23L 9/02
2012/0060819 A1 * 3/2012 Hunt ..... A47J 36/2477 220/573.1
2020/0309369 A1 * 10/2020 Jan ..... F24B 5/026

* cited by examiner

*Primary Examiner* — Alfred Basichas
(74) *Attorney, Agent, or Firm* — ScienBiziP, P.C.

(57) ABSTRACT

The present disclosure provides a stove and a stove system. The stove comprises a stove body comprising a first side wall; a fuel rack arranged in the stove body, the fuel rack and the first side wall of the stove body forming a first cavity having an upward opening; at least one protruding structure extending from at least one of the first side wall or the fuel rack and further extending into the first cavity, each of the at least one protruding structure is provided with a hollow channel and at least one air vent, at least one first air opening is provided at least one of the first side wall or the fuel rack, the at least one first air opening, the hollow channel and the at least one air vent form an airflow channel, the airflow channel draws air external to the stove body into the first cavity.

20 Claims, 13 Drawing Sheets

STOVE AND STOVE SYSTEM CAPABLE OF CONTROLLING FLAME SHAPE

RELATED APPLICATIONS

This application claims the benefit of priority to Chinese Patent Application Number 202321739138.4 filed on Jul. 4, 2023, in the China National Intellectual Property Administration. The entire contents of the above-identified application are hereby incorporated by reference.

TECHNICAL FIELD

The present disclosure relates to the technical field of stoves, specifically but not limited to a stove and a stove system capable of controlling flame shape.

BACKGROUND

At present, most stoves on the market have a bottom and a side wall connected with the bottom, and the bottom and the side wall of the stove enclose a cavity with an upward opening. Consumers can place burning wood into the upward opening cavity for cooking, heating and other needs. However, when too much wood is piled inside the stove, oxygen cannot sufficiently circulate between the wood on the lower layer, thereby resulting in a large amount of black smoke when the wood is burned.

In view of this, a new structure needs to be provided, to solve at least part of the above problems.

BRIEF DESCRIPTION OF DRAWINGS

Implementations of the present disclosure will now be described, by way of embodiment, with reference to the attached figures.

DETAILED DESCRIPTION

In order to make the purpose, technical solution, and advantages of the present disclosure clearer, further detailed descriptions will be given below in conjunction with the accompanying drawings. Obviously, the described implementation methods are only a part of the implementation methods of the present disclosure, not all of them. Based on the implementation methods in the present disclosure, all other implementation methods obtained by ordinary technical personnel in this field without creative labor fall within the scope of protection of the present disclosure.

Embodiments of the present disclosure will be described in detail hereinafter with reference to the accompanying drawings.

One optional embodiment of the present disclosure provides a stove, comprising a stove body 3 and a fuel rack 5.

Figure 1:
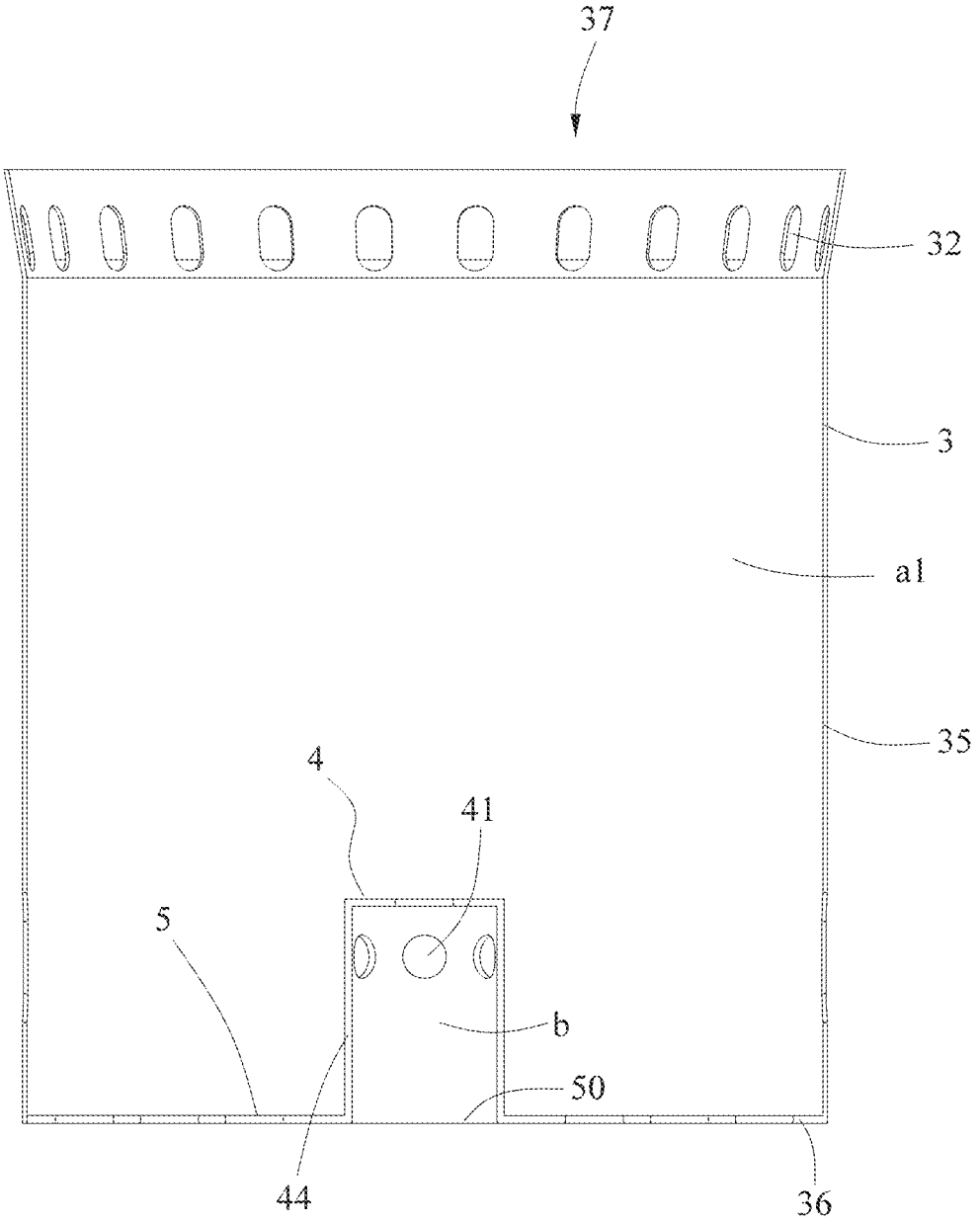
FIG. 1 shows a sectional view of a stove body having a first side wall according to one embodiment of the present disclosure.

In one embodiment, referring to FIG. 1, the stove body 3 comprises a first side wall 35, the first side wall 35 encloses an upper and a lower port, the shapes of the upper and the lower ports can be the same or different, and the shapes of the upper and the lower ports include but are not limited to circles, ovals, triangles, rectangles, etc. In another embodiment, the stove body 3 comprises a first side wall 35 and a first bottom 36 connected with the first side wall 35, and the first side wall 35 and the first bottom 36 enclose a cavity with an upper port.

Figure 2:
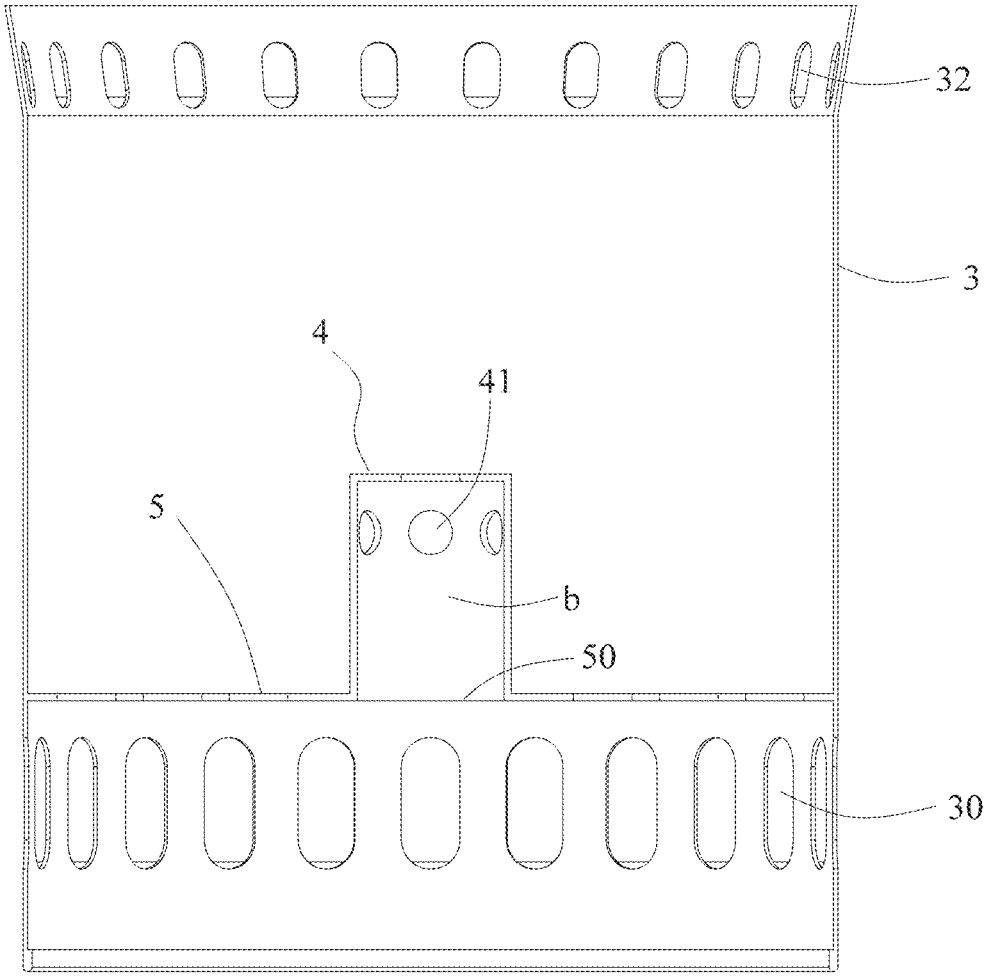
FIG. 2 shows a sectional view of a stove body having a first side wall and a first bottom according to one embodiment of the present disclosure.

The fuel rack 5 is arranged in the stove body 3 and encloses a first cavity a1 having a first upward opening 37 together with the first side wall 35 of the stove body 3. In one embodiment, referring to FIG. 1, the fuel rack 5 is arranged at the bottom of the stove body 3, and the first cavity a1 enclosed by the fuel rack 5 and the first side wall 35 of the stove body 3 is large. In one embodiment, referring to FIG. 2, the fuel rack 5 is arranged at the middle and lower parts of the stove body 3, and the first cavity a1 enclosed by the fuel rack 5 and the first side wall 35 of the stove body 3 is relatively small.

The first cavity a1 is configured to accommodate fuels, and fuels include but are not limited to solid fuels, for example, wood, charcoal, bituminous coal, solid alcohol or a mixture thereof are accommodated in the first cavity a1.

The stove further comprises at least one protruding structure 4 extending from at least one of the first side wall 35 or the fuel rack 5 and further extending into the first cavity a1, each of the at least one protruding structure 4 is provided with a hollow channel 44 extending along an extension direction of the protruding structure 4 and at least one air vent 41 in air communication with the first cavity a1.

In one embodiment, referring to FIG. 1, the fuel rack 5 is provided with at least one first air opening 50, a protruding structure 4 corresponding to the first air opening 50 is arranged at the fuel rack 5, the protruding structure 4 is provided with at least one air vent 41. The protruding structure 4 is hollowed out in the middle, thus connecting the first air opening 50 and the at least one air vent 41, and cooperatively forming an airflow channel b between the first air opening 50 and the at least one air vent 41, the airflow channel b draws air external to the stove body 3 into the first cavity a1.

Figure 3:
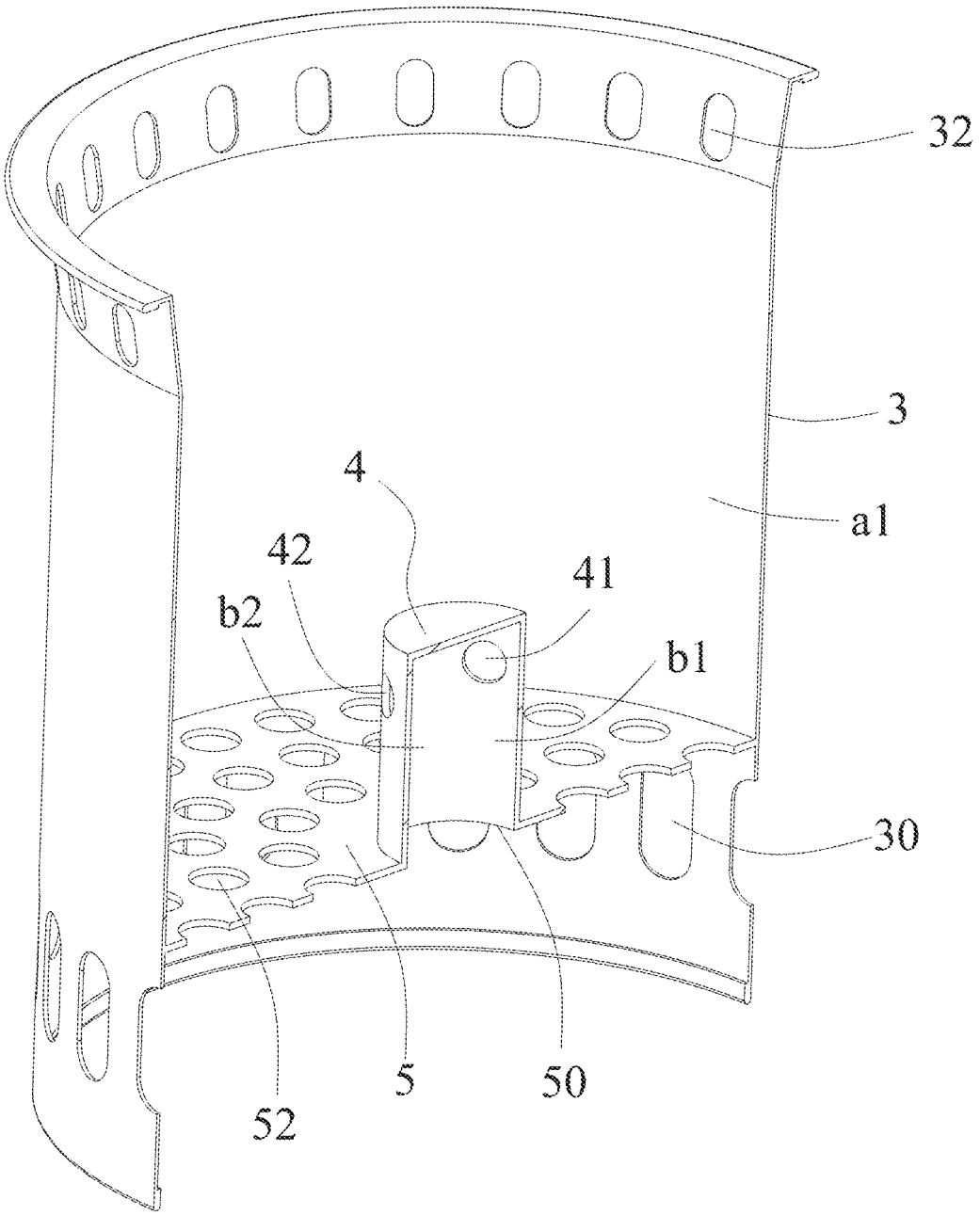
FIG. 3 shows a sectional view of a stove body having a fuel rack according to one embodiment of the present disclosure, and the fuel rack comprises a plurality of air openings.

The airflow channel b and the protruding structure 4 are further illustrated below. Referring to FIG. 3, in one embodiment, the fuel rack 5 is provided with at least one second air openings 52, the at least one second air openings 52 is configured to facilitate air to flow into the first cavity a1. The fuel rack 5 is also provided with a protruding structure 4 corresponding to the first air opening 50, and the protruding structure 4 is provided with a plurality of air vents. In one embodiment, the protruding structure 4 comprises an air vent 41 and an air vent 42. When fuels are burned, air inside the first cavity a1 is heated, under the influence of thermal expansion and contraction, the density of hot air decreases, the received gravitational force decreases, and the hot air manifests itself as escaping outwards from the first cavity a1. The amount of air inside the first cavity a1 is reduced, therefore, the pressure inside the first cavity a1 will be lower than a standard atmospheric pressure, i.e., the pressure inside the stove body 3 is small and the pressure outside the stove body 3 is relatively large, and cold air external to the stove body 3 will pass through the first air opening 50 and enter the protruding structure 4 which is hollow in the middle, and then flow into the first cavity a1 through the air vent 41 and the air vent 42 along the hollow channel 44 enclosed by the protruding structure 4, or the cold air directly enters the first cavity a1 through the plurality of second air openings 52. The first air opening 50 and the air vent 41 are communicated through the hollow channel 44 of the protruding structure 4 and form an airflow channel b1 therebetween; the first air opening 50 and the air vent 42 are communicated through the hollow channel 44 of the protruding structure 4 and cooperatively form an airflow channel b2 therebetween. As for the plurality of second air openings 52 and the air vent 41, if fuels are accommodated in the first cavity a1, the fuels may block the plurality of second air openings 52 and the air vent 41 from being communicated, therefore, the plurality of second air openings 52 and the air vent 41 fail to form an airflow channel.

Figure 4:
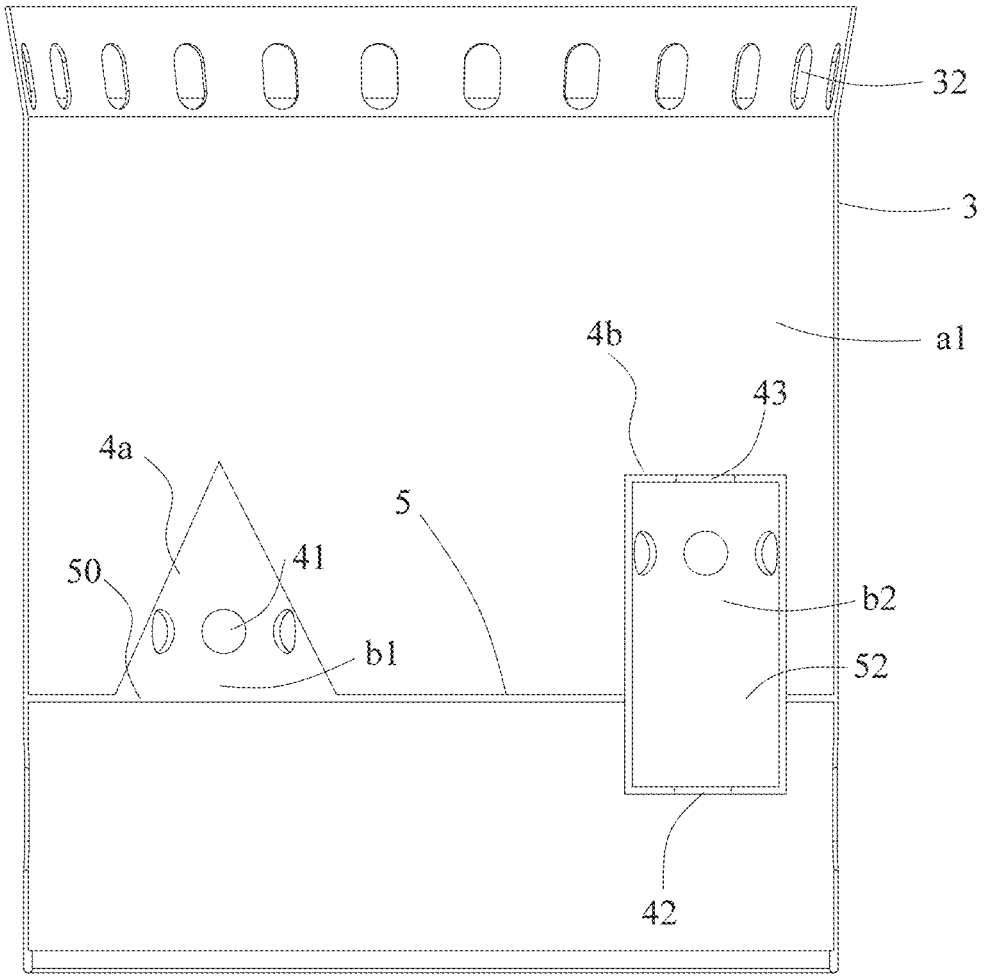
FIG. 4 shows a sectional view of a stove body having two protruding structures with different shapes according to one embodiment of the present disclosure.

Referring to FIG. 4, in one embodiment, the fuel rack 5 is provided with two first air openings 50, and a protruding structure 4*a* and a protruding structure 4*b* are arranged at the corresponding one of the two first air openings 50, the protruding structure 4*a* is provided with an air vent 41, and the protruding structure 4*b* is provided with an air vent 42 and an air vent 43. Wherein the protruding structure 4 is cone-shaped, the air vent 41 is arranged on a side wall of the protruding structure 4, and the first air opening 50 and the air vent 41 form an airflow channel b1. The protruding structure 4*b* is cylindrical, and the air vent 42 and the air vent 43 are arranged at the bottom and top of the protruding structure 4*b*, respectively. It can be seen that cold air external to the stove body 3 first enters the protruding structure 4*b* which is hollow in the middle through the air vent 42, then passes through the corresponding one of the two first air openings 50 along the channel enclosed by the protruding structure 4*b*, and finally flows to the first cavity a1 through the air vent 43. Although the side wall of the protruding structure 4*b* shields the edge of the first air opening 50, the protruding structure 4*b* still communicates the first air opening 50 and the air vent 43, therefore, the first air opening 50 and the air vent 43 form an airflow channel b2.

Referring to FIG. 4, the shape of the protruding structure comprises but is not limited to a cone, a cylinder, a rectangle, or other similar columns which are hollow in the middle, and the protruding structure corresponds to and is in air communication with the air opening on the fuel rack 5. The protruding structure may be located entirely above the fuel rack 5 (e.g., a protruding structure 4*a* of FIG. 4) or partially above the fuel rack 5 (e.g., a protruding structure 4*b* of FIG. 4). The protruding structure may be vertically connected with the fuel rack 5, or may be connected at a certain inclination angle with the fuel rack 5; the number of protruding structures may be set to 1 or more, and the air vent on each protruding structure may also be set to 1 or more, and when a plurality of air openings are arranged on the fuel rack 5 and the number of the protruding structure is 1, the protruding structure may be connected to the air opening on any one of the fuel racks 5, such that an airflow channel b is formed between the air vent and the corresponding air opening. Preferably, the protruding structure is selected to be connected to an air opening located at the very center of the fuel rack 5. When the fuel rack 5 is provided with a plurality of air openings and the number of protruding structures is also multiple, preferably, the protruding structure is selected to be connected with the air opening located at a predetermined distance from the very center point of the fuel rack 5.

In summary, the airflow channel b1 can supplement air to the first cavity a1. When too much fuel is piled up, the oxygen content in the first cavity a1 is increased due to the air (oxygen is contained in the air) brought by the airflow channel b1, so that the fuel can be more fully burned, and harmful gas and black smoke generated during burning of fuel are reduced.

As to the air opening and the air vent mentioned above, the shape of the port comprises but is not limited to a circle, an oval, a polygon and the like. It should be noted that the air vent, which is in fact also an air opening, only has the meaning of distinguishing an air opening in name, therefore, the port area of the air vent may be larger or smaller than the port area of the air opening on the fuel rack 5. In one embodiment, taking the shape of the ports of the air openings and the air vents being circular as an example, the air openings of the airflow channel b are formed, the port diameters of the hole holes are not smaller than a predetermined minimum diameter, so that the airflow channel b easily brings enough oxygen to the first cavity a1; as to the air openings that do not form the airflow channel b, the port diameters of the air openings may be smaller than the predetermined minimum diameter. In one specific embodiment, the aperture of the air opening that forms the airflow channel b is set to 5 mm, the diameter of the corresponding air vent is also 5 mm, and the aperture of the air opening that does not form the airflow channel b is 1 mm; in another specific embodiment, the aperture of the air opening that forms the airflow channel b is 5 mm, and the diameter of the corresponding air vent is 3 mm, and the aperture of the air opening that does not form the airflow channel b is 5 mm.

Figure 5:
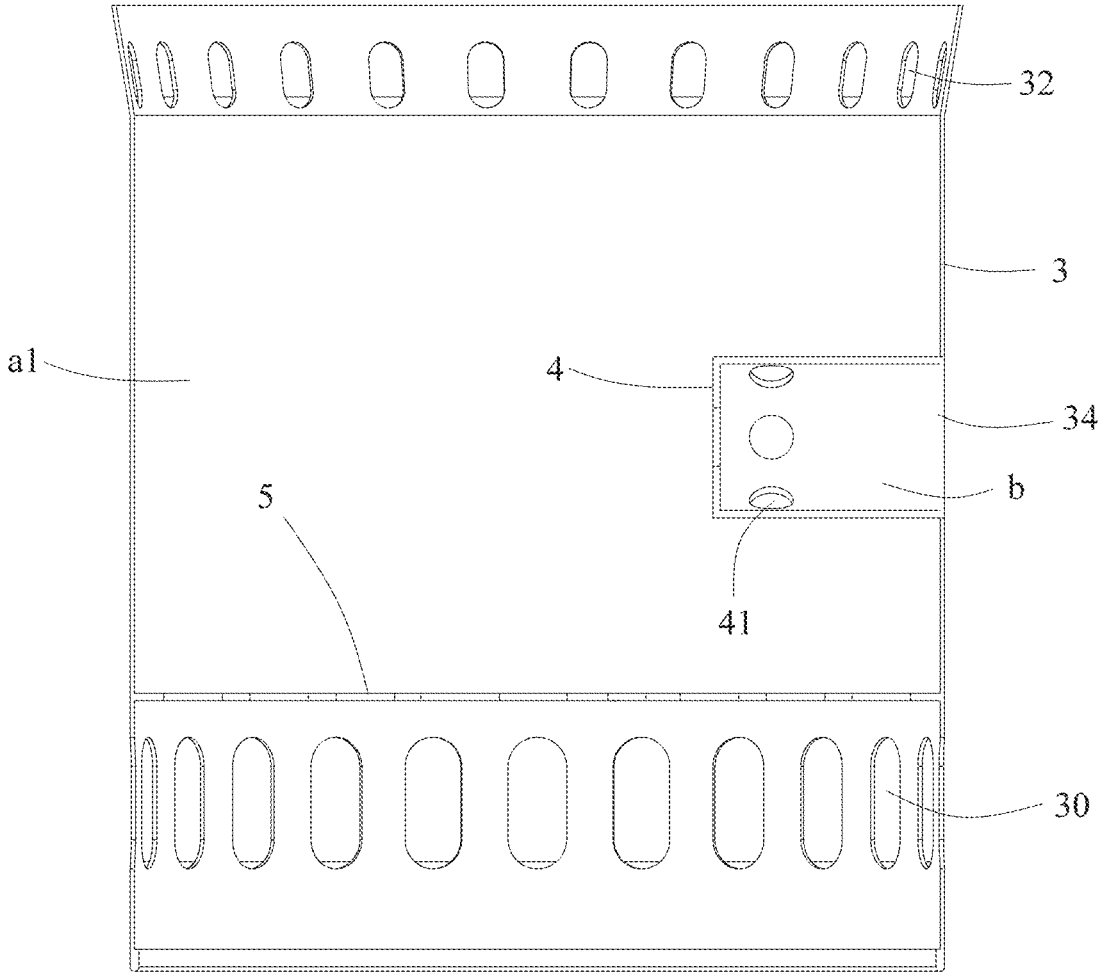
FIG. 5 shows a sectional view of a stove body having a first side wall according to one embodiment of the present disclosure, the first side wall comprises a protruding structure.

The first air opening 50 mentioned above is provided at the fuel rack 5, in another embodiment, the first air opening can also be provided at the first side wall 35 of the stove body 3. Referring to FIG. 5, the first side wall 35 of the stove body 3 is also provided with at least one first air opening 34, the first air opening 34 is provided with a protruding structure 4, the protruding structure 4 is provided with at least one air vent 41, and the first air opening 34 is in air communication with the air vent 41 through the protruding structure 4 to form an airflow channel b. For similar reasons as above, cold air external to the stove body 3 will flow to the first cavity a1 along the airflow channel b, the content of oxygen in the first cavity a1 is improved, and fuels can be burned more sufficiently, thereby reducing black smoke generated during burning of fuels.

In one embodiment, a vertical height of one of the at least one air vent of the protruding structure 4 is different from vertical heights of other air vents of the protruding structure 4, and the vertical height of the air vent is a vertical distance from the air vent to the fuel rack 5.

Figure 6:
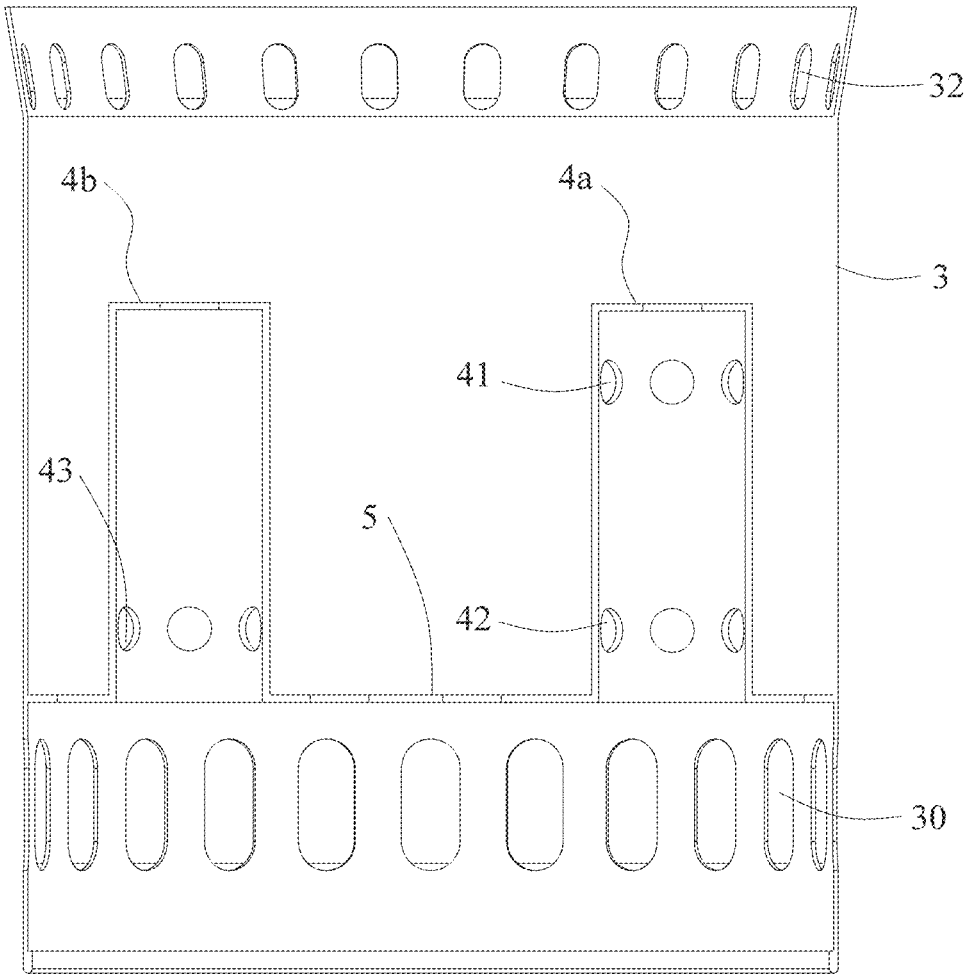
FIG. 6 shows a sectional view of a stove body having two protruding structures according to one embodiment of the present disclosure.

In one embodiment, the protruding structure 4 is provided with a plurality of air vents, the plurality of air vents are divided into multiple groups of air vents, wherein in the same group, the vertical heights of the air vents are located at the same horizontal line, while in different groups, the vertical heights of the air vents are not located at the same horizontal line, and the vertical height of the air vent is a vertical distance between the air vent and the fuel rack 5. In one specific embodiment, referring to FIG. 6, the air vents 42 at the lower part of the side wall of the protruding structure 4 may be considered as a first group of air vents 42, and the air openings 41 at the upper part of the side wall of the protruding structure 4 may be considered as a second group of air vents 41. The air vents of different groups may also come from different protruding structures, e.g., the air vents 42 at the lower part of the side wall of the protruding structure 4 may be considered as a first group of air vents 42, the air openings 41 at the upper part of the side wall of the protruding structure 4*b* may be considered as a second group of air vents 221. Due to different positions of the air vents 42, the fuel is able to perform multi-level ventilation and oxygen supplementation in a spatial dimension, thereby ensuring air permeability of the stove to the greatest extent.

Figure 7:
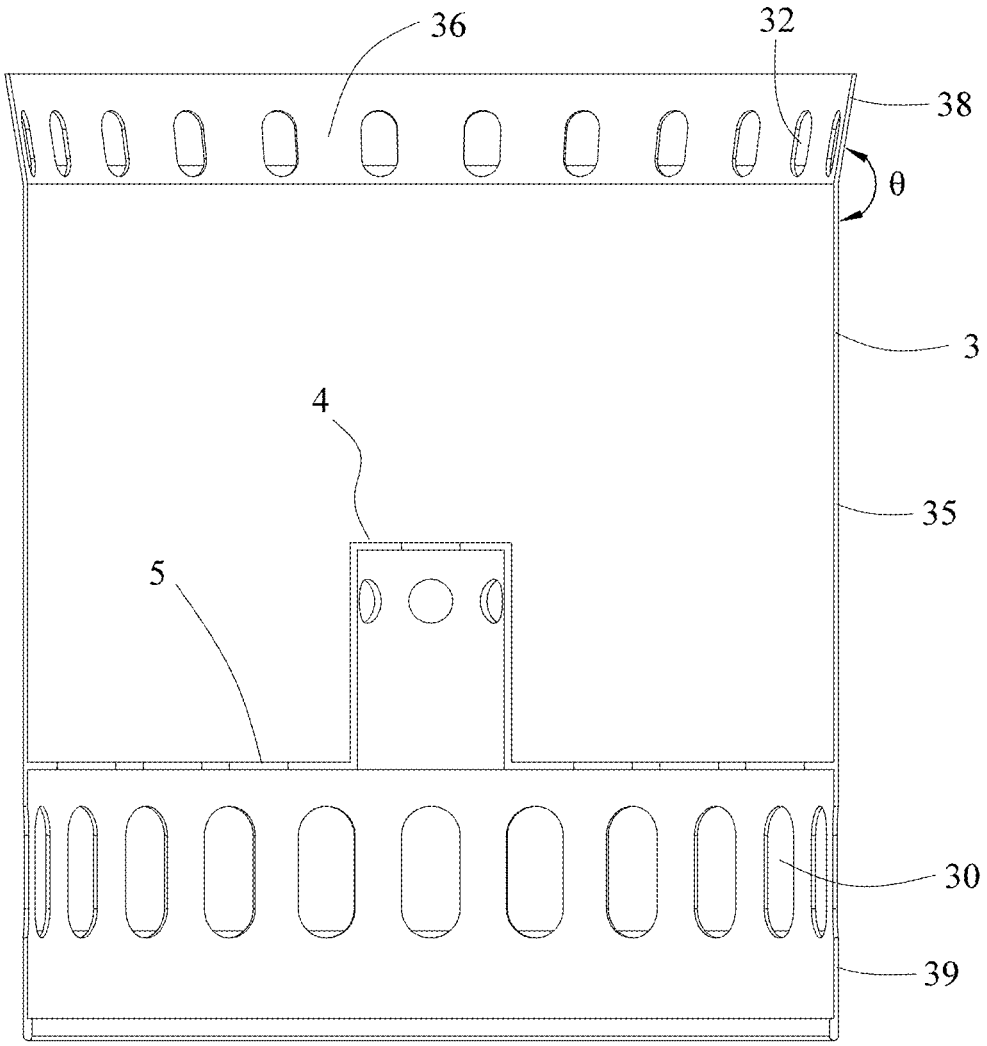
FIG. 7 shows a sectional view of a stove body having a predetermined region according to one embodiment of the present disclosure.

In one embodiment, referring to FIG. 7, the first side wall 35 of the stove body 3 comprises a top portion 38 adjacent to the first upward opening 37 and a bottom portion 39 away from the top portion 38, and at least one third air opening 30 is arranged at the bottom portion 39 of the stove body 3. During burning, the temperature of the stove body 3 will overflow outwardly, therefore, air on the outer side wall of the stove body 3 is also heated, the hot air will rise, the cold air will sink, and the hot air will gather at the upper part of the outer side wall of the stove body 3 while the cold air will gather at the lower part of the outer side wall of the stove body 3. Since the oxygen content of the cold air is greater than the oxygen content of the hot air, the at least one third air opening 102 is arranged at the lower part of the first side wall 35 of the stove body 3, to enable the cold air to flow into the first cavity a1 preferentially.

In other embodiment, the bottom portion 39 of the stove body 3 may also not comprise the third air opening 30, which is not limit herein.

In one embodiment, referring to FIG. 7, the top portion 38 comprises a predetermined region 36, and a plurality of fourth air openings 32 arranged in at least one circle are located in the predetermined region 36. During burning, hot air will flow upwards, and flame will also flow along with the hot air. The hot air overflows outwards in all directions from the first cavity a1, therefore, the flame will also outflow outwards correspondingly, then the shape of flame is loose, and sundries outside the stove body 3 are easily ignited. A ring of fourth air openings 32 are arranged at the upper part of the first side wall 35 of the stove body 3, and air at the upper part of the outer side wall of the stove body 3 flows towards the upper part of the inner side wall of the stove body 3, that is, wind blowing from the outside to the inside is formed at the upper part of the stove body 3, to drive flame in the stove body 3 to gather.

In one embodiment, referring to FIG. 7, a portion of the first side wall 35 corresponding to the predetermined region 36 expands outwardly relative to another portion of the first side wall 35 located below the predetermined region 36, so as to form an angle θ therebetween. Due to the influence of burning, air on the inner side wall and the outer side wall of the stove body 3 will be heated, hot air on the inner side wall and the outer side wall will flow upwards, since the predetermined region 36 expands outwards towards the opening on the upper end of the stove body 3, rise of hot air on the outer side wall will be hindered, and the flow rate of the hot air on the outer side wall is less than the flow rate of the hot air on the inner side wall. According to the Bernoulli principle, an object with a large flow rate is relatively small in pressure, therefore, at the upper part of the stove body 3, the pressure on the outer side wall is greater than the pressure on the inner side wall, and then air on the outer side wall flows to the first cavity a1 in an accelerated manner, and the effect of supplementing oxygen to the stove is better.

Figure 8:
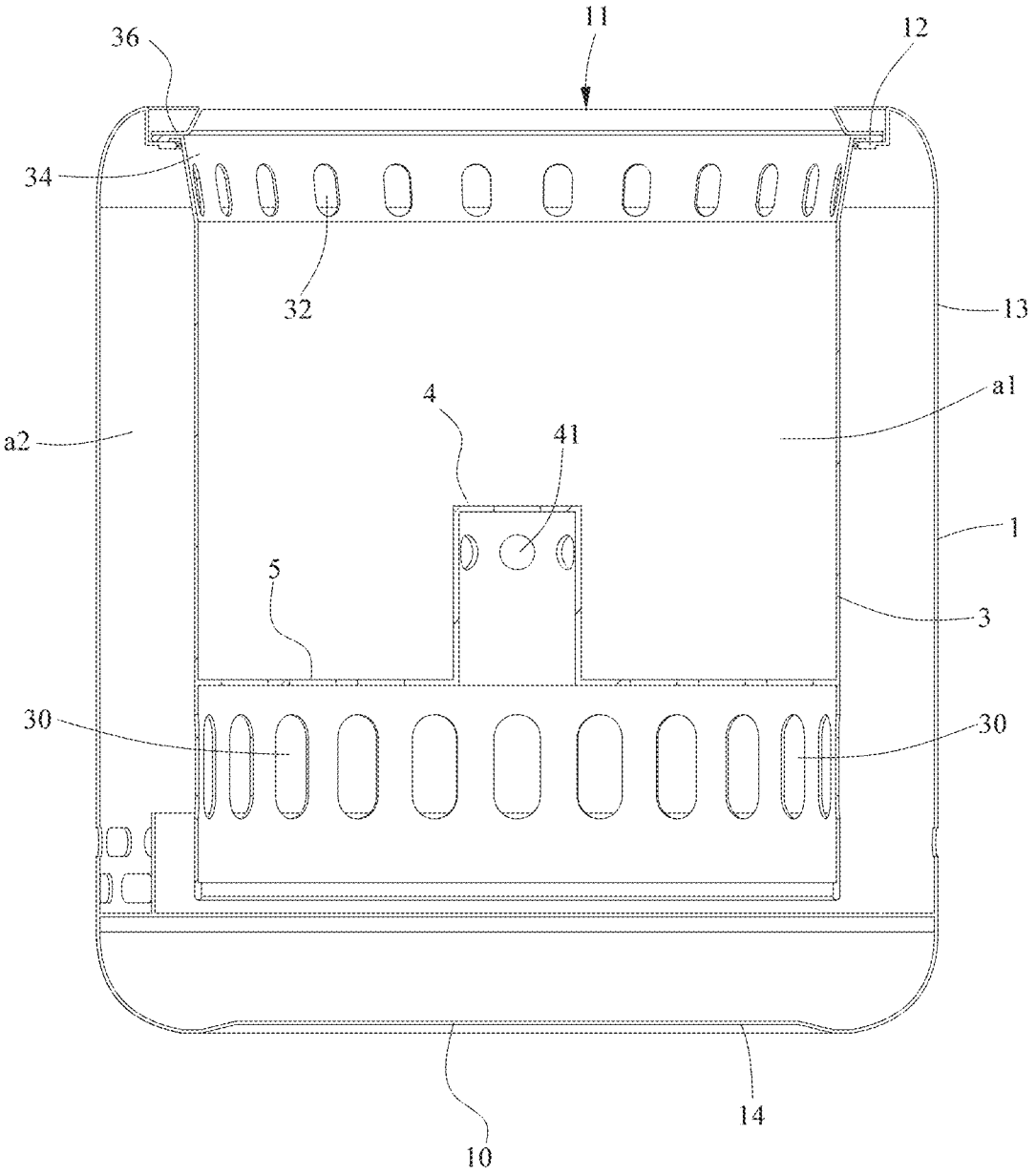
FIG. 8 shows a sectional view of a stove according to one embodiment of the present disclosure.

Referring to FIG. 8, one optional embodiment of the present disclosure provides a stove. The stove comprises the above stove body 3, the fuel rack 5 and the protruding structure 4, and further comprises a stove body sleeve 1, and the stove body sleeve 1 is arranged on the outer side of the stove body 3 in a sleeved manner at a predetermined interval space. The stove body sleeve 1 comprises a second bottom 13 and a second side wall 14 connected with the second bottom 13, the second bottom 13 of the stove body sleeve 1 and the second side wall 14 of the stove body sleeve 1 enclose a second cavity a2 having a second upward opening 11, and the second cavity a2 is configured to receive a stove body 3. In one embodiment, the second side wall 14 of the stove body sleeve 1 is parallel to the first side wall 35 of the stove body 3, such that the stove body 3 is more adapted to the second cavity a2. The stove body sleeve 1 is provided with at least one fifth air opening 10, and air external to the stove body sleeve 1 flows to the second cavity a2 through the fifth air opening 10. In one embodiment, the bottom of the stove body sleeve 1 is provided with a plurality of fifth air openings 10.

In one optional embodiment, referring to FIG. 8, the stove body 3 and the stove body sleeve 1 are both arranged to be cylindrical, the first side wall 35 of the stove body 3 is parallel with the second side wall 14 of the stove body sleeve 1, a first engagement edge is arranged on one side, away from the bottom, of the second side wall 14 of the stove body sleeve 1, the first engagement edge 36 is a supporting structure around the opening on the upper end of the stove body sleeve 1 from the inner side wall of the stove body sleeve 1 towards the second cavity a2; a second engagement edge 12 is arranged on one side, away from the fuel rack 5, of the first side wall 35 of the stove body 3, the second engagement edge 12 expands outwards from the outer side wall of the stove body 3 and is an externally extending structure around the opening on an upper end of the stove body 3. Therefore, the opening on the upper end of the stove body 3 is large and the opening on the lower end is relatively small, the stove body 3 is inserted from the opening on the upper end of the stove body sleeve 1, the first side wall 35 of the stove body 3 enters the second cavity a2, until the second engagement edge 12 abuts against the first engagement edge 36, the stove body 3 is supported by the first engagement edge 36, and is suspended and fixed in the second cavity a2.

In one specific embodiment, referring to FIG. 8, the bottom of the stove body sleeve 1 is provided with a plurality of fifth air openings 10, the upper part and the lower part of the stove body 3 are respectively provided with a plurality of first air openings 101 and fourth air openings 32, and the fuel rack 5 and the protruding structure 4 are also respectively provided with a plurality of first air openings 50 and air vents 42. When fuels in the first cavity a1 are burned, air inside the first cavity a1 and the second cavity a2 is heated, and escapes through the opening on the upper end of the stove body 3. Therefore, a difference of pressure outside and inside the stove body is formed, under the effect of pressure, air external to the stove body sleeve 1 flows to the second cavity a2 through the fifth air opening 10 at the bottom of the stove body sleeve 1, and air inside the second cavity a2 also flows to the first cavity a1 through the first air opening 34 at the lower part of the stove body 3, the air opening 122 at the upper part of the stove body 3, the first air opening 50 on the fuel rack 5 and the air vent 41 on the protruding structure 4, to provide sufficient oxygen for fuels.

Figure 9:
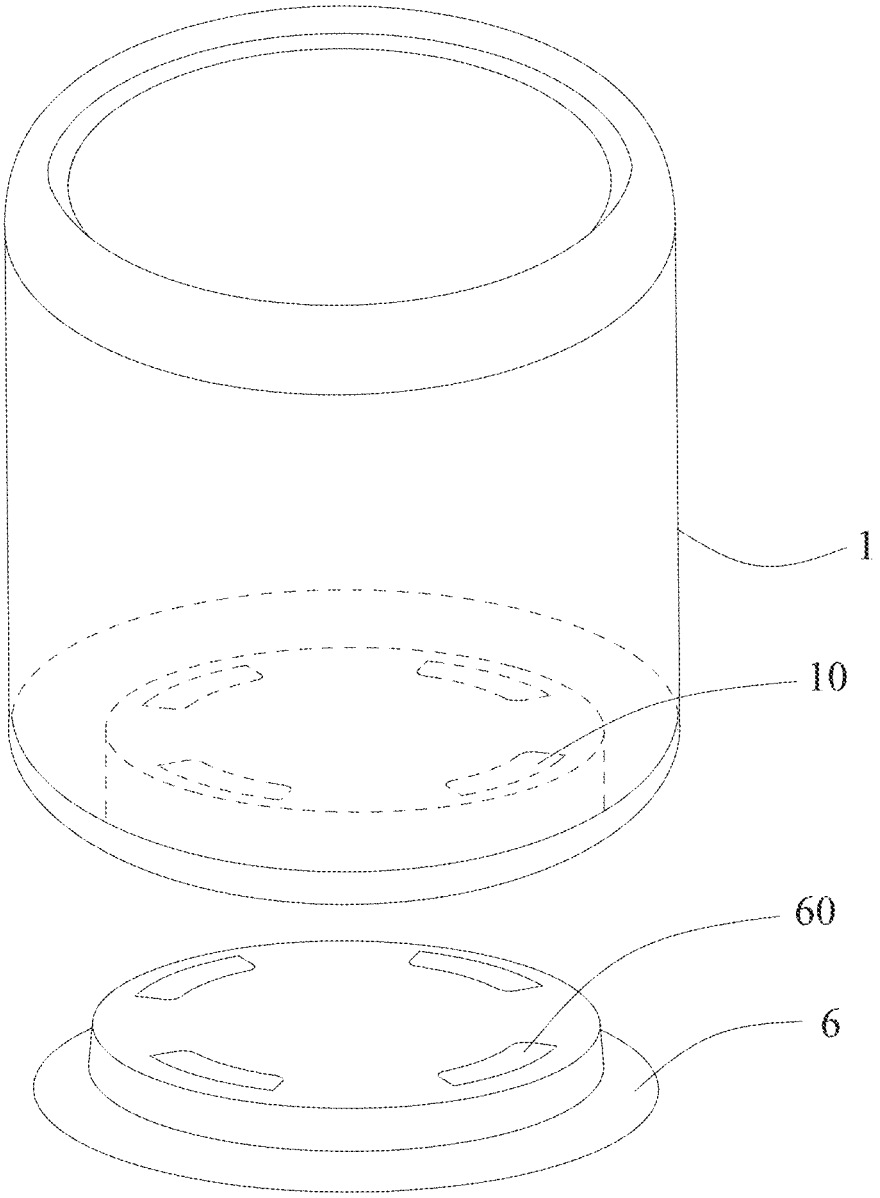
FIG. 9 shows an exploded view of a stove according to one embodiment of the present disclosure.

In one embodiment, referring to FIG. 9, the stove further comprises a partition plate 6, the partition plate 6 is movably arranged below the bottom of the stove body sleeve 1, the partition plate 6 is provided with at least one sixth air opening 60 corresponding to the at least one fifth air opening 10 at the bottom of the stove body sleeve 1, the stove can be switched between a first state, a second state and a third state through moving the partition plate 6, in the first state, each of the at least one sixth air opening 60 of the partition plate 6 is completely overlapped with the corresponding one of the fifth air opening 10 of the stove body sleeve 1, in the second state, each of the at least one sixth air opening 60 of the partition plate 6 is partially overlapped with the corresponding one of the fifth air opening 10 of the stove body sleeve 1, and in the third state, each of the fifth air opening 10 of the stove body sleeve is completely covered by the partition plate 6. Specifically, the bottom of the stove body sleeve 1 is concave inwards, the shape of the upper part of the partition plate 6 corresponds to the shape of the concave part at the bottom of the stove body sleeve 1, such that the partition plate 6 can just abuts against the bottom of the stove body sleeve 1, the upper part of the partition plate 6 is close to the bottom of the stove body sleeve 1, and the at least one fifth air opening 401 on the partition plate 6 are in one-to-one correspondence with the fifth air openings 10 at the bottom of the stove body sleeve 1. When the partition plate 6 is in a first preset position, that is, in the first state, the at least one fifth air opening 401 on the partition plate 6 is completely overlapped with the fifth air opening 10 at the bottom of the stove body sleeve 1, at this time, the amount of inlet air at the bottom of the stove body sleeve 1 is the largest; when the partition plate 6 is rotated, the partition plate 6 is in a second preset position, that is, in the second state, the at least one fifth air opening 401 on the partition plate 6 is partially overlapped with the fifth air opening 10 at the bottom of the stove body sleeve 1, that is, the partition plate 6 will shield part of the fifth air openings 10 of the stove body sleeve 1, at this time, the amount of inlet air at the bottom of the stove body sleeve 1 becomes small. When the partition plate 6 is rotated continuously, the partition plate 6 is in a third preset position, that is, in the third state, the fifth air opening 10 at the bottom of the stove body sleeve 1 is completely covered by the partition plate 6, that is, the partition plate 6 shields all the fifth air openings 10 of the stove body sleeve 1, at this time, no air is introduced at the bottom of the stove body sleeve 1. In one optional embodiment, the amount of air introduced at the bottom of the stove body sleeve 1 is changed by moving the partition plate 6 up and down. Through moving the partition plate 6 to different positions, the areas of fifth air openings 10 of the stove body sleeve 1 shielded by the partition plate 6 are different, thereby further influencing the content of oxygen in the first cavity a1 and achieving the purpose of controlling the size of flame in the stove. In one embodiment, a strip-shaped straight rod is also arranged at the side of the partition plate 6, through toggling the straight rod, the position of the partition plate 6 can be changed, and the size of the flame is adjusted.

Figure 10:
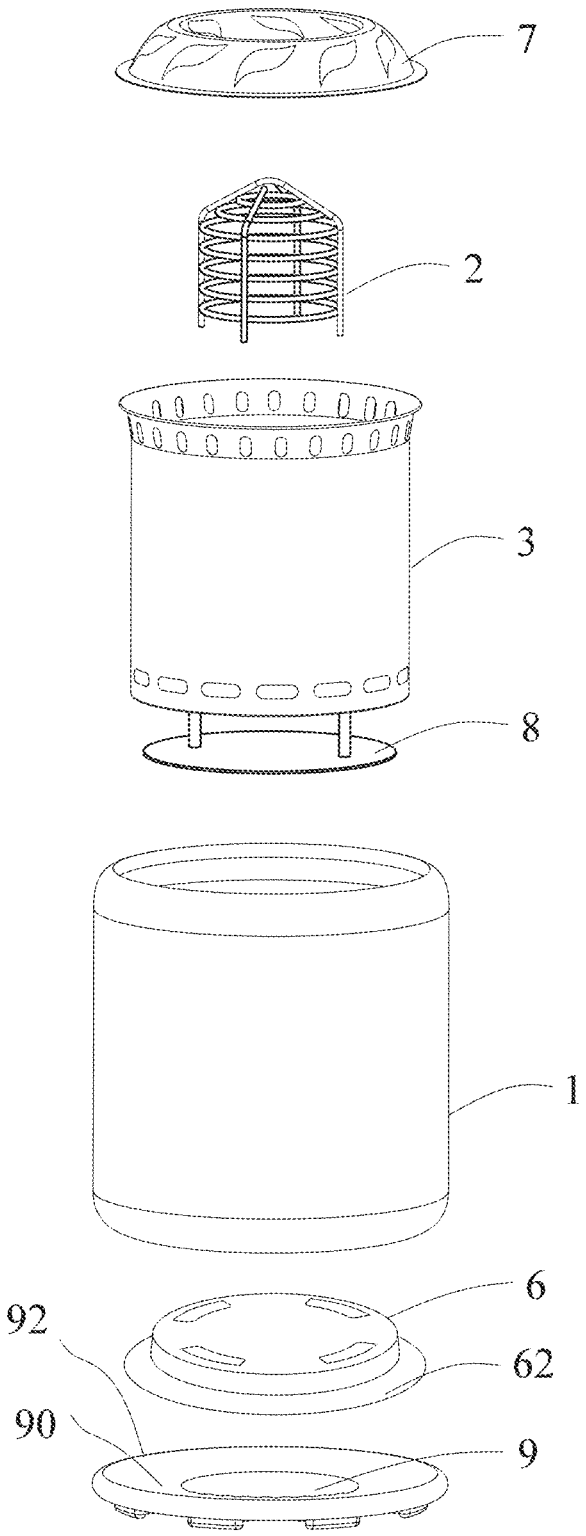
FIG. 10 shows an exploded view of a stove according to one embodiment of the present disclosure.

In one embodiment, referring to FIG. 10, the stove further comprises a base 9, the base 9 is arranged at the bottom of the stove, the base 9 is provided with a supporting member 90, the supporting member 90 and the base are configured to cooperatively support the stove. In one embodiment, the above partition plate 6 is further provided with a lower part, the lower part of the partition plate 6 expands outwards in all directions to form a third engagement edge 62, an edge of the supporting member 90 of the base 9 is provided with a protruding fourth engagement edge 92, and the third engagement edge 62 of the partition plate 6 abuts against an inner side of the fourth engagement edge 92.

In one embodiment, referring to FIG. 10, the stove further comprises a fuel isolating sleeve 2, and the fuel isolating sleeve 2 is arranged in the first cavity a1 to isolate different fuels. For example, when the fuel is wood, since wood is difficult to be ignited directly, solid alcohol or wood chips for ignition can be placed inside the fuel isolating sleeve 2, and wood can be placed outside the fuel isolating sleeve 2. Under protection of the fuel isolating sleeve 2, the space of igniters is sufficient, such that igniters can be in sufficient contact with oxygen, and can be easily burned, and igniters that burn sufficiently are also more likely to ignite wood.

In one embodiment, referring to FIG. 10, the stove further comprises an ash collecting member 8, the ash collecting member 8 is located below the fuel rack 5, through connection between a supporting pillar and the fuel rack 5, ashes falling from the fuel rack 5 are effectively received and collected, smoothness of oxygenating air flow is improved, and sufficient burning of fuels is guaranteed. The ash collecting member 8 is arranged below the fuel rack 5, thereby not influencing connection between the fifth air opening 10 of the stove body sleeve 1 and the first air opening 34 of the stove body 3, and ensuring air permeability of the stove.

In one embodiment, referring to FIG. 10, the stove also comprises a fire gathering cover 7, the fire gathering cover 7 is located above the stove body 3. The fire gathering cover 7 has a side wall with openings at both ends and the opening on the lower end of the side wall is large and the opening on the upper end is relatively small. The opening on the upper end is used for exiting fire. The relatively small opening is beneficial for concentration of the outgoing fire, improving the fire breathing speed and making the outgoing of fire more rapid. Further, in one embodiment, a blank pressing ring is arranged at the bottom edge of the side wall of the fire gathering cover 7, and the fire gathering cover 7 is fixed on the second engagement edge 12 through the blank pressing ring, such that the connection between the stove body 3 and the stove body sleeve 1 is more stable.

Figure 11:
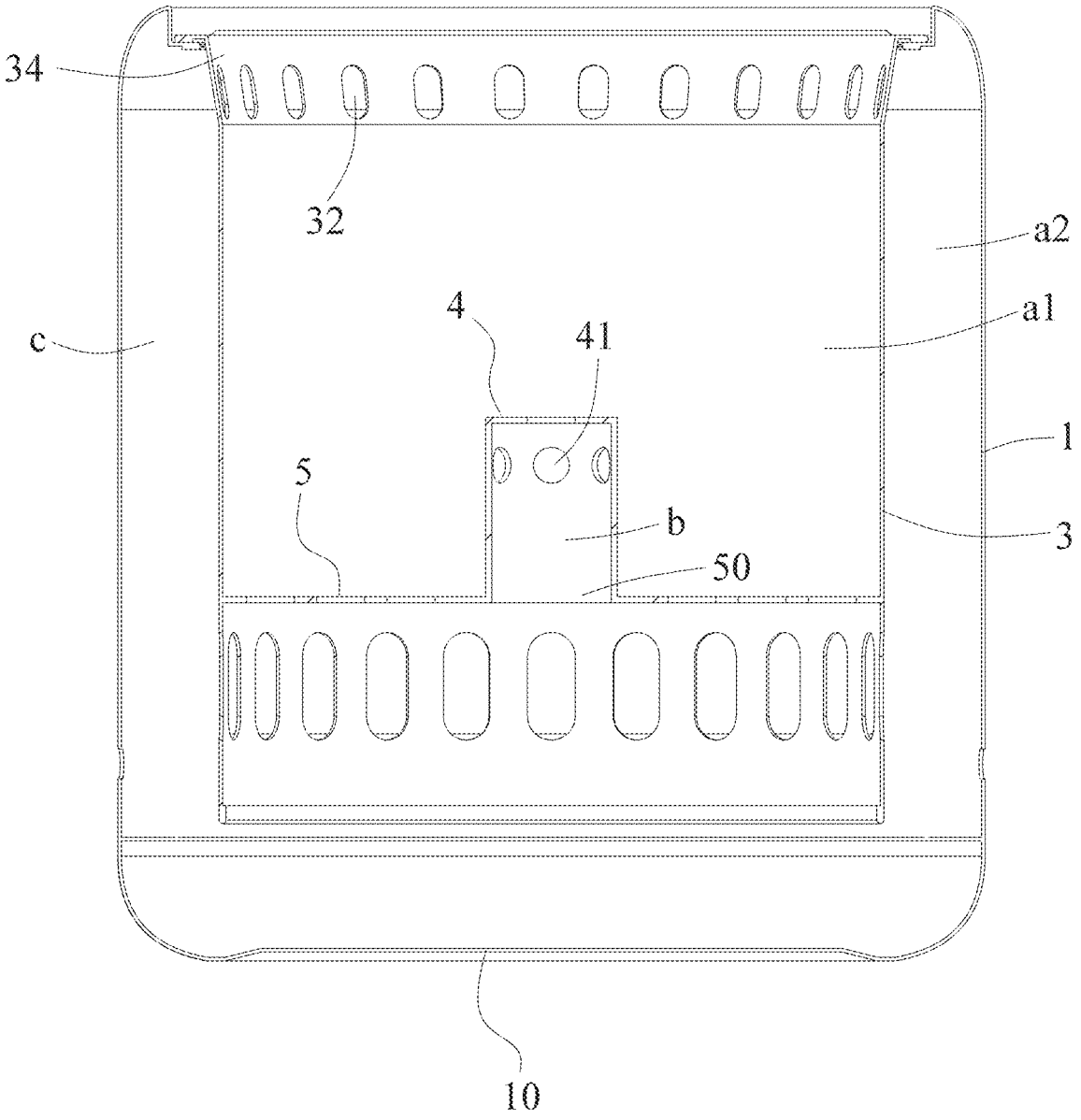
FIG. 11 shows a sectional view of a stove system configured to control flame shapes according to one embodiment of the present disclosure.

Referring to FIG. 11, one optional embodiment of the present disclosure provides a stove system capable of controlling a flame shape, and the stove system comprises a stove body 3, a fuel rack 5 and a stove body sleeve 1. Wherein the stove body 3 comprises a first side wall 35, the first side wall 35 of the stove body 3 encloses a fire outlet opening, and the upper part of the first side wall 35 of the stove body 3 is provided with a plurality of gas flow guiding elements 32, the plurality of gas flow guiding elements 32 are arranged at the upper part of the first side wall 35 of the stove body 3 and configured to change the direction of air flowing therethrough. In this embodiment, the plurality of gas flow guiding elements 32 are arranged in a circle along the first side wall 35. The fuel rack 5 is arranged in the stove body 3, and the fuel rack 5 and the first side wall 35 of the stove body 3 encloses a first cavity a1 with the first upward opening 37, and the first cavity a1 is configured to accommodate fuels. The stove body sleeve 1 comprises a bottom and a second side wall 14 connected with the bottom, the bottom of the stove body sleeve 1 and the second side wall 14 of the stove body sleeve 1 enclose a second cavity a2 having the second upward opening 11, and the second cavity a2 is configured to receive the stove body 3. The bottom of the stove body sleeve 1 is provided with an air inlet structure. In one embodiment, the air inlet structure comprises at least one fifth air opening 10. The size of the flame can be changed by changing the size of the at least one fifth air opening 10. That is, the size of the at least one fifth air opening 10 can be changed according to needs, and there is no limit here.

An outer surface of the first cavity a1 and an inner surface of the second cavity a2 form a narrow channel c in air communication with the air inlet structure and the plurality of gas flow guiding elements 32, and the narrow channel c is smaller than a preset width in a lateral direction vertical to the axial direction of the stove body 3 so as to accelerate the speed of air flowing through the narrow channel c. When fuels in the first cavity a1 are burned, air inside the first cavity a1 is heated, under the influence of thermal expansion and contraction, the density of the hot air decreases, the received gravitational force decreases, and the hot air manifests itself as escaping outwards from the first cavity a1. The amount of air inside the first cavity a1 is reduced, therefore, the pressure inside the first cavity a1 will be lower than a standard atmospheric pressure, i.e., the pressure inside the stove body 3 is small and the pressure outside the stove body 3 is relatively large, and air inside the second cavity a2 will flow to the first cavity a1 through the plurality of gas flow guiding elements 32 along the narrow channel c. The content of air in the second cavity a2 is reduced, therefore, pressure in the second cavity a2 also begins to decrease, the pressure in the stove body sleeve 1 is small and the pressure outside the stove body sleeve 1 is relatively large, and air external to the stove body sleeve 1 will flow to the second cavity a2 through the air inlet structure at the bottom of the stove body sleeve 1.

In summary, when fuels are burned, air external to the stove body sleeve 1 flows to the second cavity a2, to supplement oxygen to the second cavity a2, air newly introduced into the second cavity a2 flows to the gas flow guiding elements 32 in an accelerated manner through the narrow channel c, and changes flow direction by the plurality of gas flow guiding elements 32 and then flows to the fire outlet opening. Due to the effect of a narrow channel, the air velocity at the fire outlet opening is fast, the speed of air is fast enough to bring sufficient force to the flame, the flow direction of the air is controlled in match with the plurality of gas flow guiding elements 32, so as to shape the flame.

In one embodiment, the fuel rack 5 is provided with at least one first air opening 50, and is provided with at least one protruding structure 4 corresponding to the air opening on the fuel rack 5, the protruding structure 4 is hollow in the middle and is provided with at least one air vent 41, the protruding structure 4 is configured to communicate the first air opening 50 and the air vent 41, an airflow channel b is formed between the first air opening 50 and the air vent 41, and air external to the stove body 3 flows to the first cavity a1 through the airflow channel b. Since the airflow channel b can bring a large amount of oxygen to the first cavity a1, the fuel inside the first cavity a1 burns with a large fire, thereby quickly heating cold air newly introduced into the first cavity a1 and speeding up escape of the hot air. Quickly escaped hot air increases a difference of pressure outside and inside the stove body 3, and the flow rate of the air flowing to the first cavity a1 from the plurality of gas flow guiding elements 32 also increases, and an increase of the air flow rate brings a greater force to the flame, and easily shapes the flame.

In one embodiment, the plurality of gas flow guiding elements 32 are arranged in a predetermined region 36, and a certain angle is formed between the predetermined region 36 and the first side wall 35 of the stove body 3 outside the predetermined region 36. Generally, the first air opening 34 on the stove body 3 is parallel with the first side wall 35 of the stove body 3, therefore, the direction of air flow passing through the first air opening 34 is vertical to the first side wall 35 of the stove body 3, that is, the flame is subjected to a circle of wind vertical to the flame blowing from the outside to the inside, therefore, the flame has a narrow shape. When the included angle between each of the plurality of gas flow guiding elements 32 and the first side wall 35 of the stove body 3 is changed, the flow direction of air in each of the plurality of gas flow guiding elements 32 can be changed, thereby changing the force on the flame, and achieving a purpose of controlling the height and width of the flame. For example, the predetermined region 36 expands outwards, the direction of the air flow in each of the plurality of gas flow guiding elements 32 becomes oblique upwards, the force in the vertical flame direction becomes smaller, and the flame has an additional upward force, and the flame becomes wider and higher, the predetermined region 36 contracts inwards, the direction of the air flow in each of the plurality of gas flow guiding elements 32 becomes oblique downwards, the force in the vertical flame direction becomes smaller, and the flame has an additional downward force, and the flame becomes wider and lower.

Figure 12:
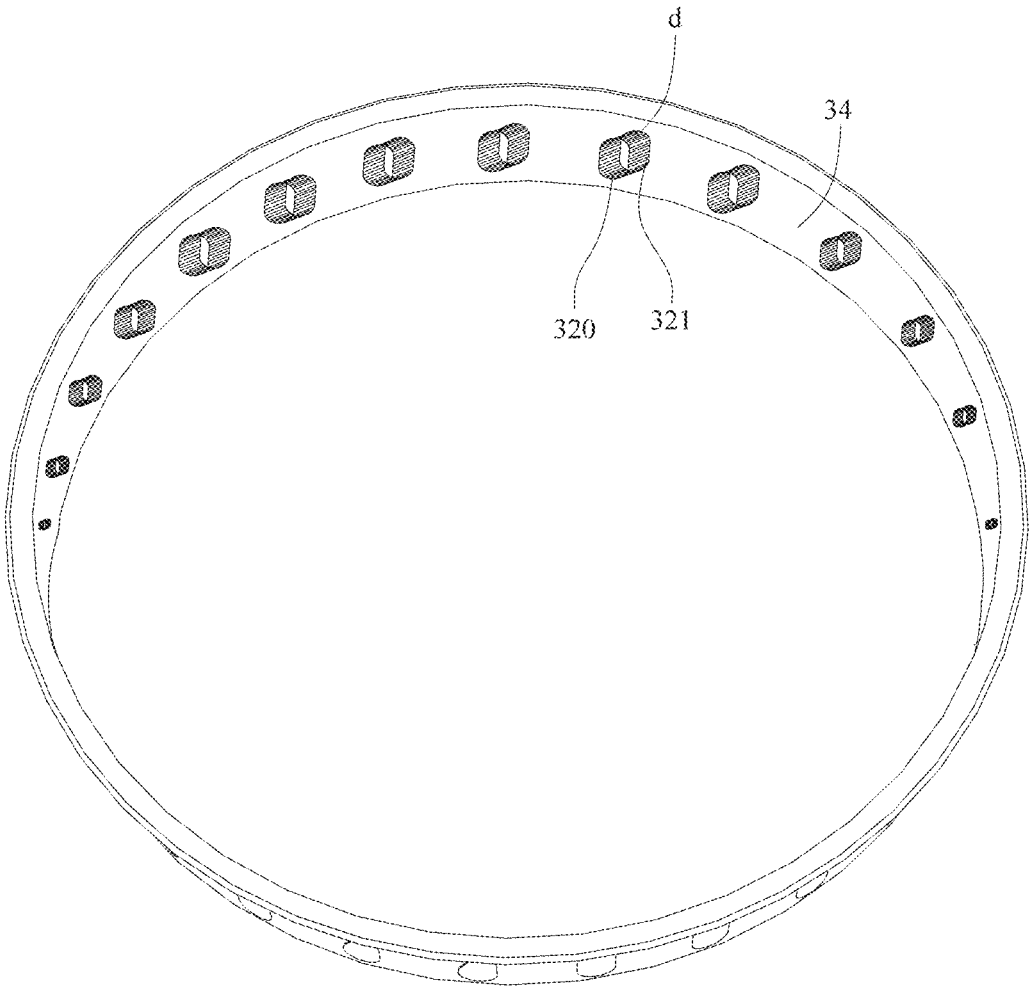
FIG. 12 shows a sectional view of an embodiment of a gas flow guiding element in the stove system shown in FIG. 11 according to one embodiment of the present disclosure.

In one embodiment, referring to FIG. 12, if the first side wall 35 of the stove body 3 is thick enough, each of the plurality of gas flow guiding elements 32 comprises an inner air opening 320 and an outer air opening 321 which are communicated, a diversion channel d is formed between the inner air opening 320 and the outer air opening 321, and the diversion channel d is inclined relative to the first side wall 35 so as to define a non-vertical angle with the first side wall 35. That is, a non-vertical angle is formed between the diversion channel d and the predetermined region 36, and the diversion channel d is inclined relative to the predetermined region 36. The diversion channel d limits the path of air flow, to change the flow direction of air. The diversion channel d brings another spatial dimension of flow direction to the air, so the flame also has an additional dimension of force (previously there were only forces in vertical and longitudinal directions, but now there is an additional force in forward and backward directions). The forces in the vertical, forward and backward directions cause the flame to rotate inwards, thereby improving the ornamental properties of the flame.

The shapes of the inner air opening 320 and the outer air opening 321 include but are not limited to circles, ovals, triangles, rectangles or other polygons. In one embodiment, the shape 101 of the inner air opening 320 and the outer air opening 321 can be the same or different, for example, the inner air opening 320 can be set to be small and the outer air opening 1031 can be set to be relatively large, the inner air opening 320 can be set to be circular and the outer air opening 1031 can be set to be rectangular, and the requirements of different flame shapes can be satisfied through setting the inner air opening 320 and the outer air opening 321 with different shapes and sizes.

Figure 13:
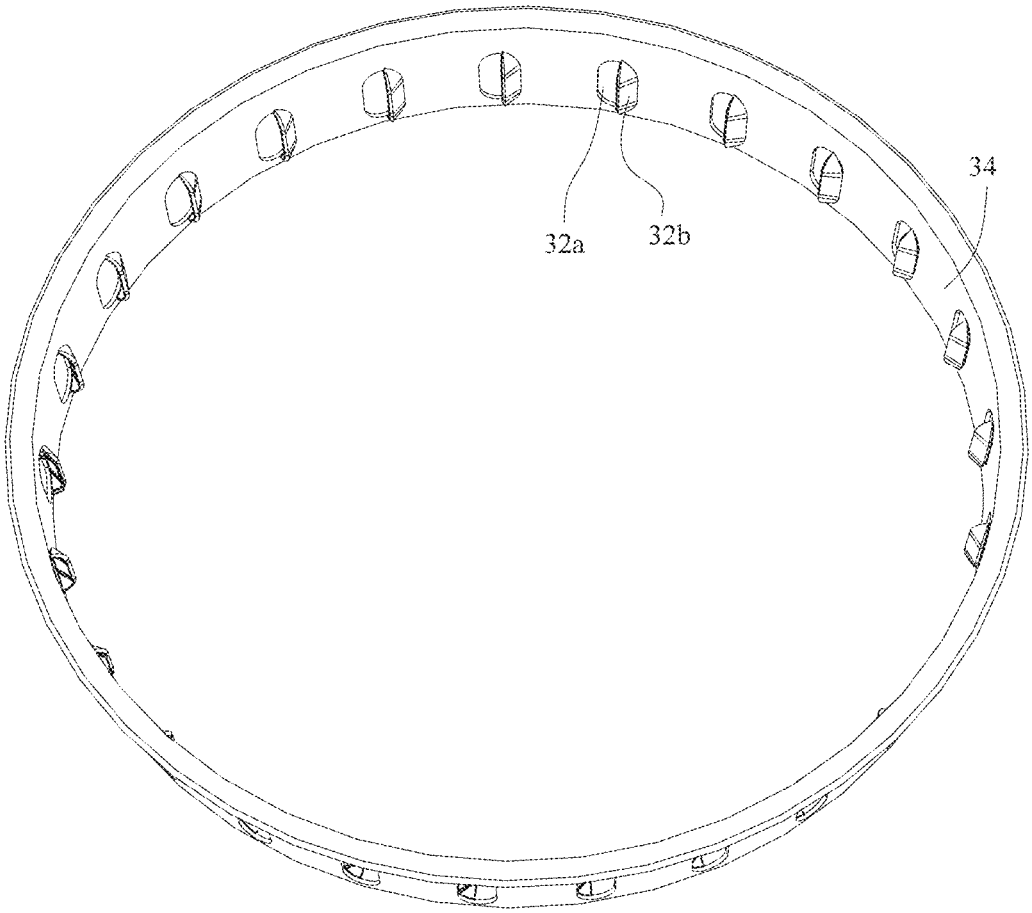
FIG. 13 shows a sectional view of another embodiment of a gas flow guiding element in the stove system shown in FIG. 11 according to another embodiment of the present disclosure.

In another embodiment, referring to FIG. 13, each of the plurality of gas flow guiding elements 32 comprises a vent aperture 32*a* and a protruding object 32*b* abutting against the vent aperture 32*a*, and the protruding object 32*b* is configured to change the flow direction of air in the vent aperture 32*a*. Based on similar reasons, the protruding object 32*b* brings another spatial dimension of flow direction to the air, so the flame also has an additional dimension of force. The forces in the vertical, forward and backward directions cause the flame to rotate inwards, thereby improving the ornamental properties of the flame.

In addition, those skilled in the art should understand that the above embodiments are only used to illustrate the present disclosure, but not used to limit the present disclosure, and appropriate changes and modifications made to the above embodiments belong to the scope of the disclosure of the present disclosure as long as they are within the scope of the substantive spirit of the present disclosure

What is claimed is:

1. A stove comprising:

a stove body comprising a first side wall;

a fuel rack arranged in the stove body, wherein the fuel rack and the first side wall of the stove body form a first cavity having a first upward opening, the first cavity is configured to accommodate fuels;

a protruding structure extending from the fuel rack and further extending into the first cavity, wherein the protruding structure is provided with a hollow channel extending along an extension direction of the protruding structure and at least one air vent in air communication with the first cavity;

a stove body sleeve comprising a bottom and a second side wall connected with the bottom, and at least one first air opening corresponding to the protruding structure is provided at the fuel rack, the at least one first air opening is in air communication with the hollow channel of the protruding structure, the at least one first air opening, the hollow channel and the at least one air vent cooperatively form an airflow channel, the airflow channel draws air external to the stove body into the first cavity, wherein the second side wall of the stove body sleeve and the bottom of the stove body sleeve enclose a second cavity having a second upward opening, and the second cavity is configured to receive the stove body, the stove body sleeve is provided with at least one fifth air opening, and an air flow path is defined from the at least one fifth air opening such that air external to the stove body sleeve flows to the second cavity through the at least one fifth air opening of the stove body sleeve.

2. The stove according to claim 1, wherein at least one second air opening is formed at the fuel rack and configured to facilitate air to flow into the first cavity.

3. The stove according to claim 1, wherein a vertical height of one of the at least one air vent of the protruding structure is different from vertical heights of other air vents of the protruding structure, and the vertical height of the air vent is a vertical distance from the air vent to the fuel rack.

4. The stove according to claim 1, wherein the first side wall of the stove body comprises a top portion adjacent to the first upward opening and a bottom portion away from the top portion, and at least one third air opening is arranged at the bottom portion of the stove body.

5. The stove according to claim 1, wherein the first side wall of the stove body comprises a top portion adjacent to the first upward opening and a bottom portion away from the top portion, the top portion comprises a predetermined region, and a plurality of fourth air openings arranged in a circle are located in the predetermined region.

6. The stove according to claim 5, wherein a portion of the first side wall corresponding to the predetermined region expands outwardly relative to another portion of the first side wall located below the predetermined region, so as to form an angle between the portion of the first side wall and the other portion of the first side wall is defined.

7. The stove according to claim 1, wherein a first engagement edge is arranged on one side, away from the bottom, of the second side wall of the stove body sleeve, a second engagement edge is arranged on one side, away from the fuel rack, of the first side wall of the stove body, and the second engagement edge abuts against the first engagement edge, such that the stove body is suspended in the second cavity.

8. The stove according to claim 1, wherein the at least one fifth air opening is provided at the bottom of the stove body sleeve.

9. The stove according to claim 8, wherein the stove further comprises a partition plate movably arranged below the bottom of the stove body sleeve and provided with at least one sixth air opening corresponding to the at least one fifth air opening of the stove body sleeve.

10. The stove according to claim 9, wherein the stove further comprises a base provided with a supporting member configured to support the stove.

11. The stove according to claim 10, wherein a third engagement edge which expands outwards in all directions is arranged at the lower part of the partition plate, an edge of the supporting member of the base is provided with a protruding fourth engagement edge, and the third engagement edge of the partition plate abuts against an inner side of the fourth engagement edge.

12. The stove according to claim 1, wherein the stove further comprises a fuel isolating sleeve arranged in the first cavity to isolate fuels of different types.

13. The stove according to claim 1, wherein the stove further comprises an ash collecting member located below the fuel rack and configured to collect ashes falling from the fuel rack.

14. A stove system capable of controlling flame shape, the stove system comprising:

a stove body comprising a first side wall, wherein a fire outlet opening is enclosed at an upper part of the first side wall of the stove body, and a plurality of gas flow guiding elements are arranged at the upper part of the first side wall of the stove body and configured to change the direction of air flowing therethrough;

a fuel rack arranged in the stove body, wherein the fuel rack and the first side wall of the stove body form a first cavity having a first upward opening, the first cavity is configured to accommodate fuels;

a stove body sleeve comprising a bottom and a second side wall connected with the bottom, wherein the stove body sleeve is provided with an air inlet structure, the bottom of the stove body sleeve and the second side wall of the stove body sleeve enclose a second cavity having a second upward opening, and the second cavity is configured to receive the stove body; and an outer surface of the first side wall and an inner surface of the second side wall form a narrow channel smaller than a preset width in a lateral direction vertical to the axial direction of the stove body so as to accelerate the speed of air flowing through the narrow channel, the narrow channel is in air communication with the air inlet structure and the gas flow guiding element.

15. The stove system according to claim 14, wherein the fuel rack is provided with at least one first air opening, and is provided with at least one protruding structure corresponding to the first air opening on the fuel rack, the protruding structure is hollow in the middle and is provided with at least one air vent, the protruding structure is in air communication with the first air opening and the air vent, an airflow channel is formed between the first air opening and the air vent, and air external to the stove body flows to the first cavity through the airflow channel.

16. The stove system according to claim 14, wherein the air inlet structure comprises at least one fifth air opening provided at the bottom of the stove body sleeve.

17. The stove system according to claim 14, wherein the first side wall of the stove body comprises a top portion adjacent to the first upward opening and a predetermined region defined in the top portion, the gas flow guiding element is arranged in the predetermined region.

18. The stove system according to claim 17, wherein the gas flow guiding element comprises an inner air opening and an outer air opening connected to the inner air opening, a diversion channel is formed between the inner air opening and the outer air opening, the diversion channel is inclined relative to the first side wall so as to define a non-vertical angle with the predetermined region.

19. The stove system according to claim 17, wherein the gas flow guiding element comprises a vent aperture and a protruding object abutting against the vent aperture, and the protruding object is configured to change flow direction of air in the vent aperture.

20. A stove comprising:

a stove body comprising a first side wall;

a fuel rack arranged in the stove body, wherein the fuel rack and the first side wall of the stove body form a first cavity having a first upward opening, the first cavity is configured to accommodate fuels; and a protruding structure extending from the fuel rack and further extending into the first cavity, wherein the protruding structure is provided with a hollow channel extending along an extension direction of the protruding structure and at least one air vent in air communication with the first cavity, and at least one first air opening corresponding to the protruding structure provided at the fuel rack, wherein the at least one first air opening is in air communication with the hollow channel of the protruding structure, the at least one first air opening, the hollow channel and the at least one air vent cooperatively form an airflow channel, the airflow channel draws air external to the stove body into the first cavity, the first side wall of the stove body comprises a top portion adjacent to the first upward opening and a bottom portion away from the top portion, the top portion comprises a predetermined region, and a plurality of fourth air openings arranged in a circle is located in the predetermined region, a portion of the first side wall corresponding to the predetermined region expands outwardly relative to another portion of the first side wall located below the predetermined region, and an angle is formed between the portion of the first side wall and the other portion of the first side wall.

* * * * *